US007341629B2

(12) United States Patent
Sapp et al.

(10) Patent No.: US 7,341,629 B2
(45) Date of Patent: Mar. 11, 2008

(54) METHOD, SYSTEM AND APPARATUS FOR SCRAPING A ROLL SURFACE IN A MOLTEN METAL COATING PROCESS

(75) Inventors: Erin G. Sapp, Vestavia, AL (US); Michael D. Hickman, Kensington, OH (US); Scott E. Brooks, Salem, OH (US); James M. Piper, Navarre, OH (US)

(73) Assignee: United States Steel Corporation, Pittsburgh, PA (US)

( * ) Notice: Subject to any disclaimer, the term of this patent is extended or adjusted under 35 U.S.C. 154(b) by 353 days.

(21) Appl. No.: 11/058,127

(22) Filed: Feb. 15, 2005

(65) Prior Publication Data

US 2006/0180079 A1 Aug. 17, 2006

(51) Int. Cl.
*B05C 11/00* (2006.01)

(52) U.S. Cl. ..... 118/70; 118/696; 118/423

(58) Field of Classification Search ..... 118/696–704, 118/70, 423; 164/158, 480, 428; 101/425, 101/423; 15/256.51, 256.53
See application file for complete search history.

(56) References Cited

U.S. PATENT DOCUMENTS

| | | | |
|---|---|---|---|
| 1,387,896 | A | 8/1921 | Maskrey |
| 3,977,842 | A | 8/1976 | Mayhew |
| 5,614,266 | A | 3/1997 | Cox et al. |
| 5,792,266 | A | 8/1998 | Falia et al. |
| 5,965,210 | A | 10/1999 | Tada et al. |
| 6,004,507 | A | 12/1999 | Morando |
| 6,485,570 | B2 | 11/2002 | Iida et al. |
| 2001/0022156 | A1 | 9/2001 | Iida et al. |

FOREIGN PATENT DOCUMENTS

| | | | |
|---|---|---|---|
| DE | 4441243 | A1 | 5/1996 |
| JP | 361133369 | A | 6/1986 |
| JP | 361139658 | A | 6/1986 |
| JP | 406002096 | A | 1/1997 |
| JP | 02002285308 | A | 10/2002 |
| JP | 02003301251 | A | 10/2003 |

*Primary Examiner*—Brenda A. Lamb
(74) *Attorney, Agent, or Firm*—McNees Wallace & Nurick LLC

(57) ABSTRACT

An apparatus for scraping the surface of a sink roll in a molten metal coating process comprises a support member having a pair of linearly movable arms supported thereon. The support member depends from a bridge structure spanning a continuous metal coating line, and a pair or arms, the arms being disposed on opposite sides of said support member. Each arm has a scraper assembly portion attached thereto. Each scraper assembly portion has two blades affixed thereto, a forward scraper blade and a rear scraper blade, with a connecting portion connecting the two blades. The connecting portion also has a first pivot point for attaching the connecting portion to the arm associated with the scraper assembly portion, the first pivot point being disposed between said forward and rear scraper blades for following the radial contours of the roll surface. A second pivot point permits the blades to follow the crown of the roll. Pneumatic cylinders advance the arms such that at least one scraper blade presses against the roll surface under pressure. There is also control means for controlling the pressure of the scraping force of said blades applied to the roll surface. A traversing means provides for communicating lateral movement of said blades laterally along the axis of the roll while scraping against the roll.

29 Claims, 8 Drawing Sheets

METHOD, SYSTEM AND APPARATUS FOR SCRAPING A ROLL SURFACE IN A MOLTEN METAL COATING PROCESS

FIELD OF THE INVENTION

The present invention relates to an apparatus for scraping a roll surface to remove surface deposits that cause surface defects in a molten metal coating process.

BACKGROUND OF THE INVENTION

Continuous hot-dip galvanizing lines are known in the art. A cleaned strip of steel is heat-treated and passed from the furnace into a coating bath without being exposed to air. The coating bath contains molten zinc or zinc-aluminum (Zn—Al) alloy. As the strip emerges from the coating bath, an air knife is directed at both sides of the strip to control the weight and thickness of the coating.

After the strip enters the coating bath from the submerged furnace snout, the strip is held under the surface of the liquid metal by a submerged roll called a sink roll. Inter-metallic particles and oxides form in the bath and create undesirable substances known as dross. Dross occurs in several forms, and each form has several causative factors. The primary causes of dross are impurities in the bath (primarily iron) and temperature differentials between the molten bath, the entering substrate steel, and the sink roll equipment. Dross can form on the sink roll, causing degradation in the quality of the coated strip metal in the form of dents, resulting in defective product that fails to meet product specifications. By successfully removing the dross from a sink roll, it is possible to increase the yield and the quality of the coating process.

A sink roll assembly with accumulated dross must be replaced periodically for machining of the surface within acceptable tolerances. In zinc-aluminum continuous coating lines, replacement of a sink roll frequently takes two to four hours, and sometimes longer, during which the continuous production line is idle. When there is no dressing or scraping of the sink roll, a typical sink roll assembly in a high-speed coating line operates for three to five days, (or nine to fifteen operating shifts). The roll assembly must be disassembled, machined and reassembled, at considerable time and expense, before it can be placed back into the coating line.

In some cases, dross is removed manually by a worker manipulating a pole-mounted scraper, requiring the worker to stand directly above the pot containing molten metal 55% Zn—Al at 1100° F. For worker safety and for environmental reasons, it is desirable to avoid handling manual tools directly above liquid metal.

Mechanical scrapers have also been employed to solve the problem of dross buildup. There are two types of mechanical scrapers for cleaning the dross from sink rolls. A full-width blade is a stationary blade contacting the rotating sink roll. The blade extends the entire width of the sink roll. The full width blade wears to the profile of the sink roll over time due to the constant friction. Sink rolls are periodically removed for resurfacing, and may be machined with a crowned profile. Also if dross does appear on a sink roll despite the use of the full width mechanical scraper, the defect creates a wear spot on the scraper blade, thus permanently transferring a defect to the finished steel product.

A second type of mechanical scraper blade employs a short blade, approximately ¼ or less of the roll width. The short-blade scraper device is disposed above the molten metal bath and traverses the entire width of the sink roll by a worm drive, from which the scraper blade depends. The pressure applied by the scraper blade against the sink roll is adjusted by various means, such as by a system of weights and flotation device appended to the scraper arm to counter the weight of the blade; or by the use of a scraper blade drive unit responsive to a torque sensing device to regulate the pressure of the traversing blade. The use of a torque sensor unit in combination with a scraper blade driver is complex and expensive. The floatation device, however, is cumbersome and inflexible, requiring the operator to physically add or remove weights or floats for adjustment. Moreover, the positioning of a worm drive above a molten metal bath introduces corrosion and bending of the worm drive member in the hot environment.

Controlling the force applied to the sink roll by the scraper is critical, since the sink roll rotates by the frictional force between the steel and the sink roll as the strip passes under the sink roll. The application of excessive force may cause the sink roll to slip against the steel strip, creating scratches and other defects. By contrast, application of insufficient force may result in accumulation of dross.

Thus, there is a need for an improved sink roll scraper blade system with automatically controlled scraping pressure, and a traversing means disposed away from exposure to the molten metal bath.

SUMMARY OF THE INVENTION

Essentially, the preferred embodiment of the apparatus comprises a pair of independently controlled, twin-bladed articulated scraper heads mounted on movable arms, with pneumatic pressure control, that permits a methodical wiping of the entire surface of a roll as the submerged roll rotates in a pot, and scraper blades traverse the roll along its axis.

According to one aspect of the invention, there is disclosed an apparatus for scraping a roll surface in a molten metal coating process comprising a support member having a pair of linearly movable arms supported thereon. The support member depends from a bridge structure spanning a continuous metal coating line, and a pair of arms, the arms being disposed on opposite sides of said support member. Each arm has a scraper assembly portion attached thereto. In a preferred embodiment, each scraper assembly portion has two blades affixed thereto, a forward scraper blade and a rear scraper blade, with a connecting portion connecting the two blades. The connecting portion has a first pivot point for attaching the connecting portion to the arm associated with the scraper assembly portion, the first pivot point being disposed between said forward and rear scraper blades for following the radial contours of the roll surface. Connecting portion also includes a second pivot point to allow the blades to pivot along the crowned axis of the roll. There is provided a means for advancing the arms such that at least one scraper blade presses against the roll surface under pressure. There is also control means for controlling the pressure of the scraping force of said blades applied to the roll surface. A traversing means provides for communicating lateral movement of said blades laterally along the axis of the roll while scraping against the roll.

Means for advancing arms comprises a cylinder operatively connected to and responsive to a source of pressurized gas. Scraper assembly connecting portion also has a pair of limit portions to restrict the angle of rotation about the pivot point of said blade assembly in relation to said arm. There may also be included means for pivotally connecting each said scraper assembly to the associated arm to create a second degree of rotation for said scraper assembly relative to said arm, to allow said blades to pivot along the crowned axis of the roll.

In a preferred embodiment the means for advancing arms comprises a cylinder operatively connected to and responsive to a source of pressurized gas, the pressure in said cylinder being is variably controlled by said control means.

A control means comprises a digital controller in electronic communication with an analog device, such as a proportional control valve, such that the pressure may be varied over a predefined range corresponding to zero pressure up to full line pressure. Traversing means comprises a motor, an actuator portion, and a cylinder portion, the cylinder portion being operatively connected to the support member, such that the motor drives said actuator portion, thereby imparting linear motion to the support member through said cylinder portion, causing said blade or blades to traverse the horizontal axis of the roll in contact with the surface of the roll.

A speed control interface in electronic communication with said motor portion and said control means controlling the speed of said motor from a speed reference point communicated from said control means.

In another aspect of the invention, a method is disclosed for scraping a roll surface rotating in a molten metal coating process comprising traversing a support assembly to one side, lifting the arms attached to said the assembly to a fully retracted position to disengage scraper blades from contact with a roll surface; initiating a scraping cycle by means of a trigger signal; lowering the arms and scraper blades in the mid-point of the sink roll; increasing the pressure reference from lifting pressure to approximately zero; energizing one or more directional valves; increasing the pressure value gradually to a preselected pressure; extending the cylinder in a controlled manner to engage the scraper head gently on to the sink roll; moving the engaged scraping head at a controlled, predetermined speed from the sink roll mid point to the fully traversed out position; stopping the traversing means upon reaching the fully traversed out position; and lifting the scraper head from the roll surface by removing pressure from the cylinder; then repeating the sequence until a predetermined number of cycles are completed.

In another aspect of the method, a counter is incremented in the control means after each cycle, comparing said counter after each repetition of a cycle, repeating another cycle until a pre-selected number of cycles is completed, and then traversing the support assembly to one side of the sink roll and lifting the arms away from the surface of the roll. The trigger may be selected from one or more of the following: a timer which activates the sequence on a regular time based interval; a weld signal from the weld tracking logic in the PLC; or an operator initiated "Cycle Now" pushbutton.

It is an object of the invention to provide two or more independently operated arms that allow one or more scrapers to independently scrape against the roll to remove dross and other surface imperfections.

It is further object of the invention to provide twin-blade articulated scraper heads in pressurized contact against the roll and transverse the blades across the roll during rotation.

A further object of the invention is to provide a methodical wiping of the entire roll face during roll rotation through traverse motion of the scraper heads, allowing every point on the roll face to contact the front and back blades at least one time during roll rotation and traversal of the scraper heads.

Yet another object of the invention is to provide optional independent control of the scraper heads.

Another object of the present invention is to provide pivotal motion of each scraper head in two directions to conform to roll radius or curvature, and to the roll axis or crown.

It is still another object of the invention to provide a pressurized cylinder coupled to each scraper head for advancing and retracting the associated scraper head under controlled pressure, which is adjustable by the operator to apply more or less pressure as required.

Another object of the present invention is to provide a digital processor system for controlling the pressure applied by scraper blades against the roll, and for controlling the speed and travel of the scraper heads traversing the roll surface.

Another object of the present invention is to provide a structural support and integrity, with minimal weight, for the scraper heads and movement arms.

A further object of the invention is to provide a transport drive mechanism that is remote from the heat of the molten metal pot, to either side and not directly above the pot.

Further objects of the invention will be made apparent in the following Detailed Description and the appended claims.

DETAILED DESCRIPTION OF THE INVENTION

Figure 1:
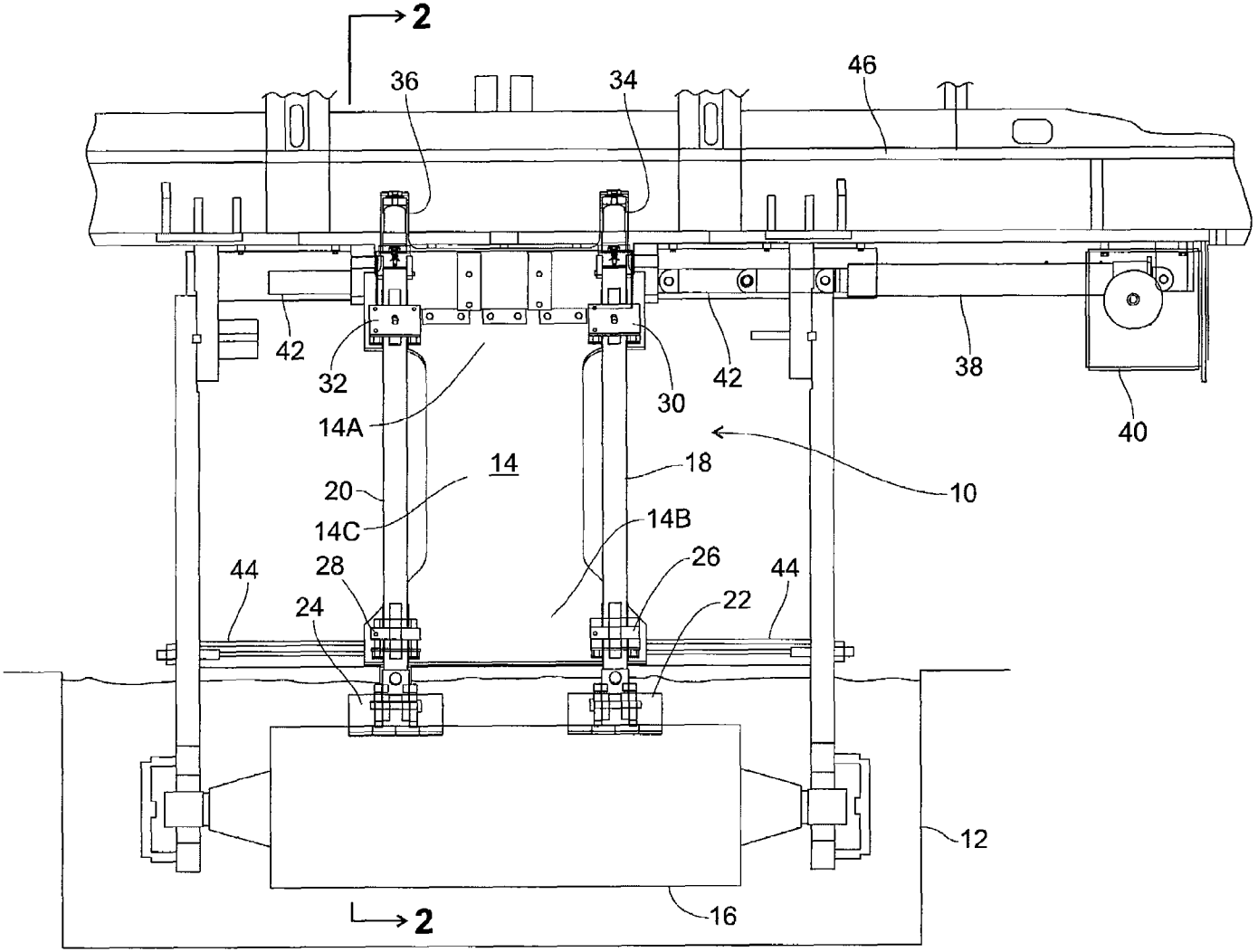
FIG. 1 is a front elevational view of the invention.
Figure 2:
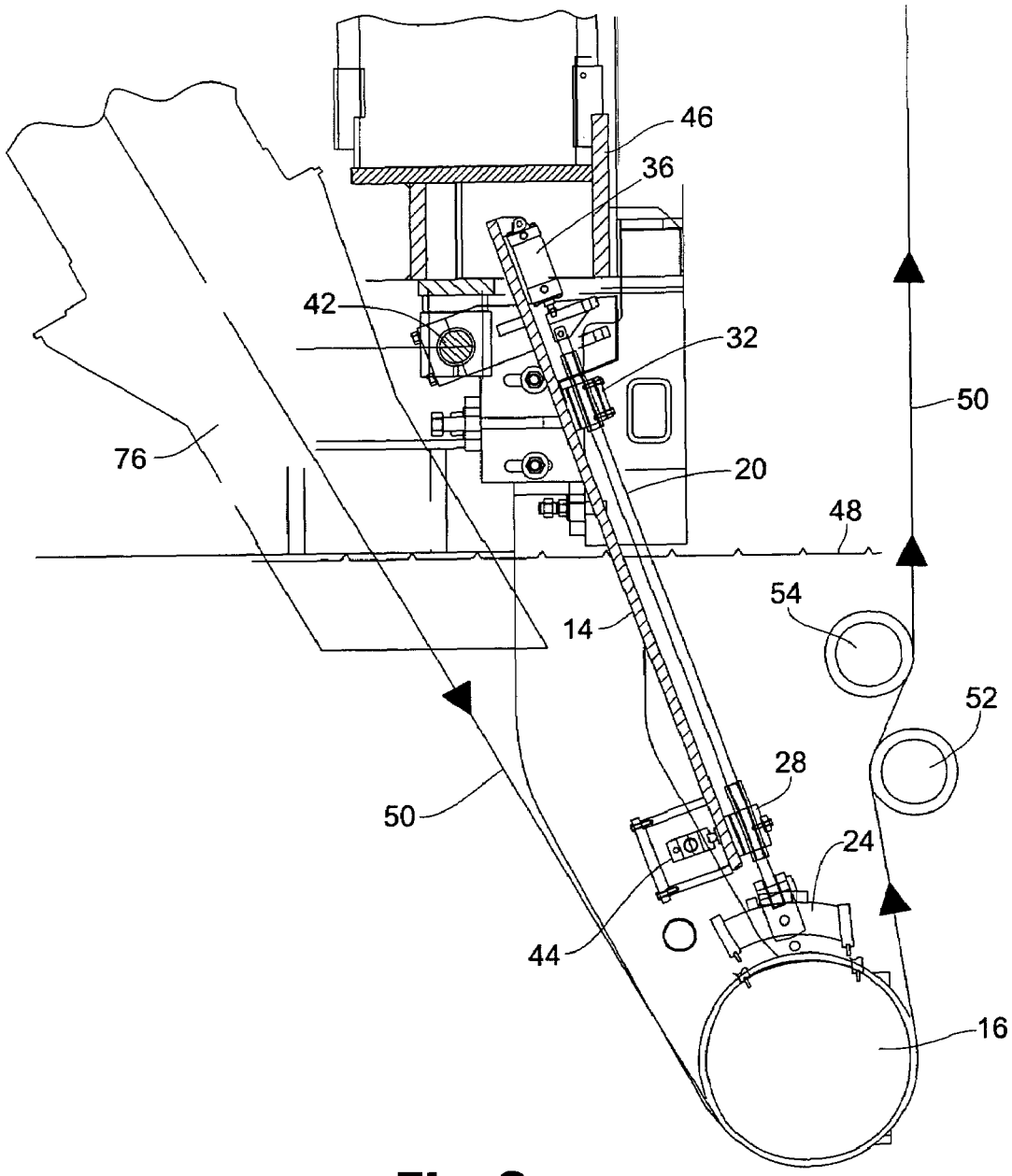
FIG. 2 is a sectional view taken along the lines 2-2 in FIG. 1.

Referring to FIGS. 1 and 2, a portion of a continuous metal strip coating line is shown. The continuous steel strip 50 is fed at an oblique angle into a pot 12 containing molten zinc or zinc/aluminum alloy, passing under a sink roll 16 redirecting the strip upward and out of the pot into a pair of rollers. The sink roll is suspended in the pot from a bridge support structure 46 spanning the coating line.

A sink roll scraper assembly is generally designated as 10. A sink roll 16 is submerged in a molten metal pot 12. The sink roll scraper assembly 10 includes a support member 14 having a pair of scraper arms 18, 20. An arm 18 or 20 is disposed at either side of support member 14. Each scraper arm 18, 20 has a scraper head assembly 22, 24 attached at an end adjacent to the sink roll 16. Scraper arm 20 at one side of the support member 14 is captured in a lower guide sleeve 26, 28 and an upper guide sleeve 30, 32, to align the scraper arm when advancing and retracting the scraper head assembly 24. Similarly, on the opposite side of support member 14, scraper arm 18 is captured at two points on the support member at guide sleeve 26 and guide sleeve 30. Guide sleeves have an annular opening coaxially aligned with the associated arm to permit lower telescoping movement for advancing and retracting the scraper head assembly 22. Support member 14 is preferably comprised of a rigid, durable plate material capable of withstanding high temperature. To minimize the weight of the support member, in the preferred embodiment, support member includes horizontal top and bottom arms 14*a*, 14*b*, connected by a web portion 14*c*. The side edges of the web 14*c* are cut away, to form an hourglass shaped backing plate. Other structural configurations for the support member may be employed, within the scope of the appended claims.

Cylinder 34, is operatively connected to scraper arm 18 and cylinder 36 is operatively connected to arm 20. Each cylinder advances or retracts the arm with which it is associated. Arms 18, 20 may operate independently of one another. In normal operation, both arms operate so as to cover the entire width of the roll in a single cycle. Preferably, the cylinders are pneumatically pressurized with direction action pressing the scraper head assembly into contact with the roll; and pressurized in the opposite direction so as to retract scraper head assemblies 22, 24 away from contact with the roll when not scraping.

A traversing cylinder 38 is driven by an electromechanical actuator motor 40, which acts on transport shaft 42 to impart lateral movement to scraper assembly 10, such that scraper head assemblies 22, 24 traverse back and forth to cover the entire surface of sink roll 16. Traversing cylinder 38 and electromechanical actuator motor 40 are positioned off to one side of pot 12, removed from the heat radiating directly above the pot. A lower transport rail 44 is provided to both support the scraper assembly and to guide the lateral movement of the lower portion of scraper assembly 10. Rail 44 preferrably employs a wear coating to reduce friction. Rail 44 prevents the arms 18, 20 from kicking back, and positions support member 14 in an inclined plane directed at roll 16.

As can be seen in FIG. 2, the continuous steel sheet 50 exits oven chute 76 below the surface of molten metal 48, the chute having a controlled atmosphere to prevent oxidation of the steel surface. Sheet 50 travels under sink roll 16, upward to first exit roller 52, then to second exit roller 54. After the strip passes the second exit roller 54, the strip exits the molten metal and passes through air knifes (not shown) suspended above the surface of the molten metal.

Figure 3:
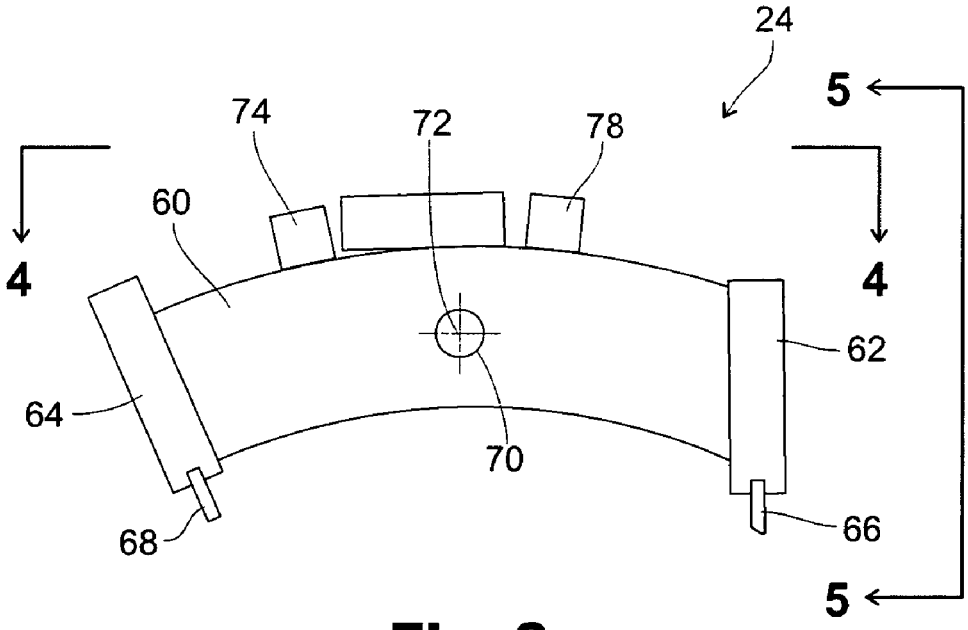
FIG. 3 is an elevational view of the scraper blade assembly.

Referring next to FIG. 3, there is a side view of one scraper head assembly 24. Scraper head assemblies 22, 24 are substantially identical. First connector portion 60 has an aperture 70 into which pin 72 is inserted, for articulating the head assemblies to conform to the circular profile of the sink roll. In the preferred embodiment, two blades are employed on each scraper assembly. However, it is noted a single blade embodiment may also be employed, within the scope of the appended claims. In the dual-blade embodiment, forward blade holder 62 is attached to first connector portion 60 at one end. Rear blade holder 64 is attached to the first connector portion 60 at the end opposite forward blade holder 62. Forward blade holder 62 has forward blade 66 removably attached to the bottom edge for scraping away surface imperfections. A rear blade 68 is removably attached to rear blade holder 64. Blades 66, 68 are replaceable wear elements. Rear blade 68 engages a surface of the sink roller to scrape any imperfections that are missed by the front blade 66, such as when forward blade 66 becomes damaged, so as to avoid the necessity to replace forward blade 66 for minor imperfections for which rear blade 68 compensates. Hinge pin 72 mates with an eye (not shown) on hinge portion 84 (shown in FIG. 5) attached to the end of scraper arm 20.

Figure 4:
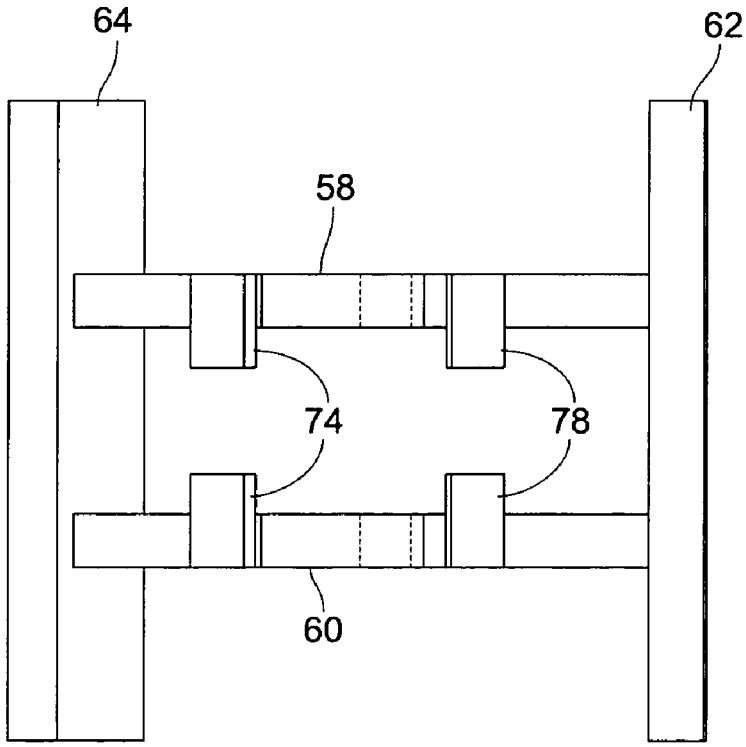
FIG. 4 is a plan view of the scraper blade assembly taken along the lines 4-4 in FIG. 3.
Figure 5:
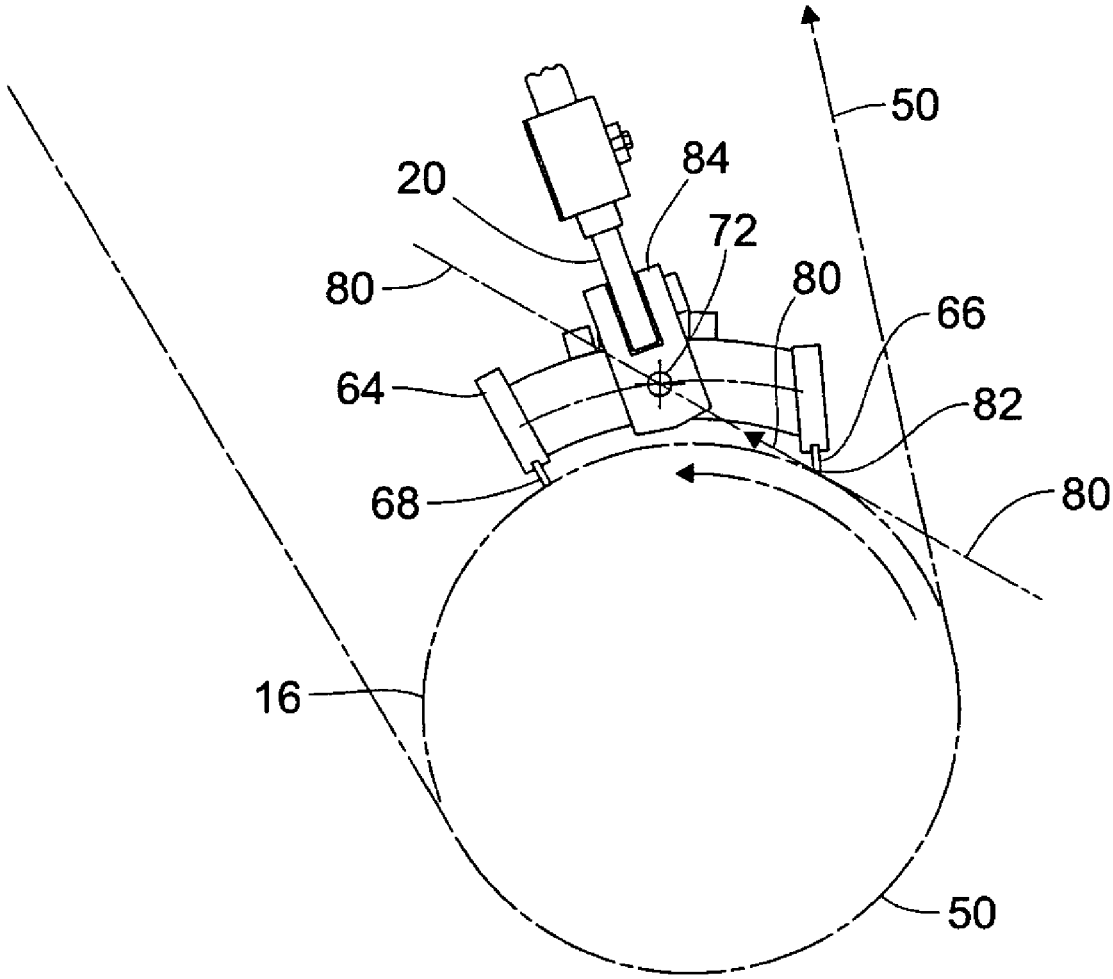
FIG. 5 is a schematic diagram of the scraper blade assembly and roll.

Referring to FIG. 4, a top view of the scraper head assembly 24 is taken along the lines 4-4 of FIG. 3. A second connector portion 58 is shown with forward blade holder 62 attached at a forward end and rear blade holder 64 attached at the opposite end of second connector portion 58. Stop limits 74, 78 are provided to limit the rotation of the head assembly about hinge pin 72. In the preferred embodiment, the allowable articulation angle is approximately six degrees. More or less articulation is not necessary, as the front blade 66 may lift too easily from the roll surface, or alternately, be unduly restricted. Connector portions 58,60 may be curved as illustrated in FIG. 5 to accommodate the roll curvature. While the preferred embodiment discloses two connector portions connecting blade holders, a singular connector portion, or a plurality of connector portions may be alternately employed.

Referring next to FIG. 5, there is a schematic diagram showing the intersection of sink roll 16 and pivot point of hinge pin 72 at a tangent line 80. Tangent line 80 passes through a point 82 at which scraper blade 62 impinges against sink roll 16. Tangent line 80 intersects the sink roll at a peripheral point 82 and passes above or through the axis of pin 72. Maintaining this angular relationship minimizes blade chatter at the point 82 at which forward blade 66 impinges upon the roll. The lifting force caused by the rotation of sink roll 16 causes the forward blades to chatter results It is advantageous to eliminate or reduce chatter to prevent surface flaws due to the lifting of forward blade 66. The inventors have determined that the defined tangent line 80 must pass through the axis or above the axis of the pivot point of hinge pin 72 in order to achieve a stable relationship that avoids chatter. Further, rear blade 68 and blade holder 62 provide stabilization of forward blade and holder 66, 62 by resisting blade chatter. Rear blade 68 impinges at an angle that is either perpendicular or intersects with the roll at an acute angle to the roll surface, so as to avoid the tenancy of the sink roll rotation to lift the rear blade.

Control of Scraper Arms

Figure 6:
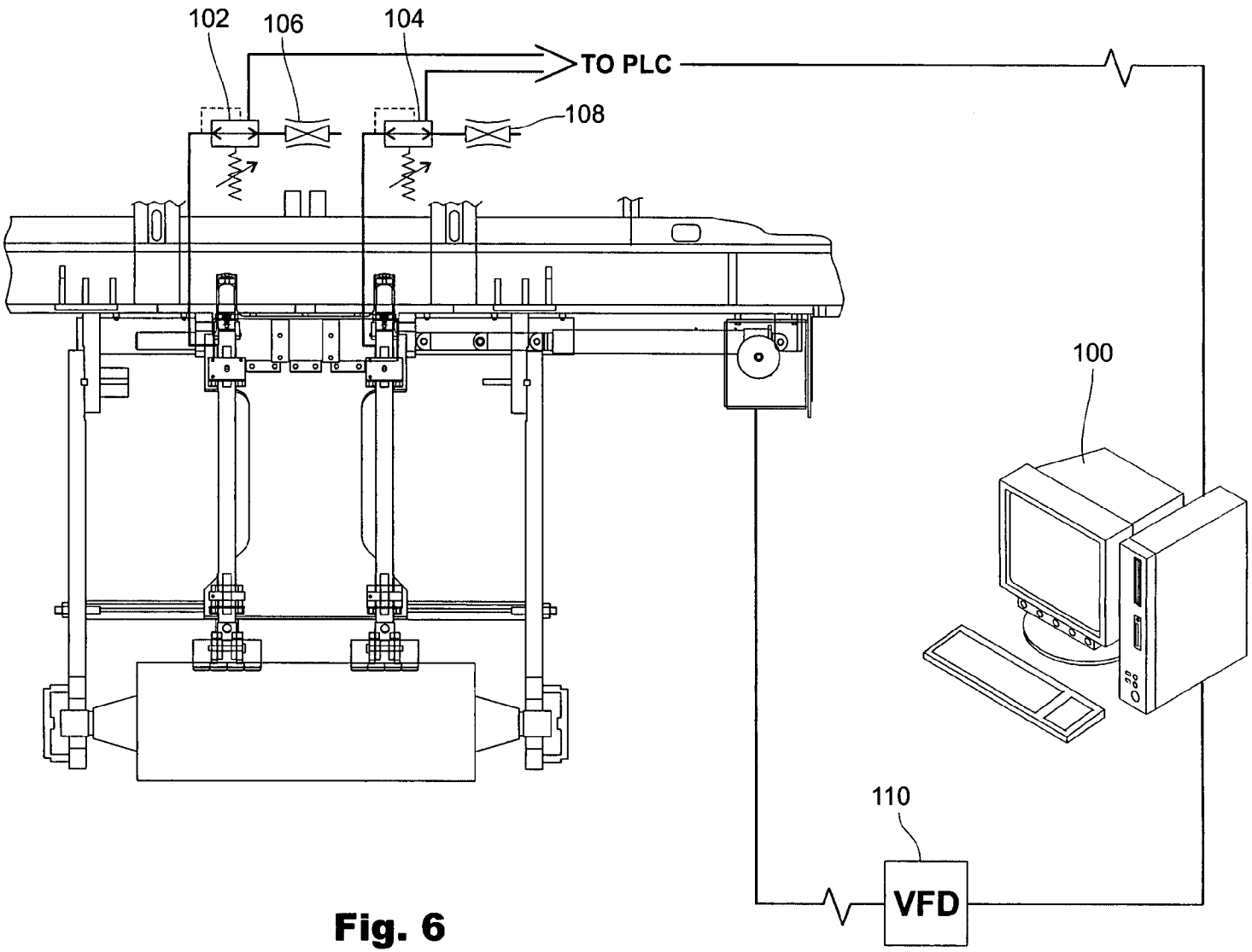
FIG. 6 is a schematic diagram of the control system.

Control of the linear arm movements and the traversing movements may be accomplished in several ways, including direct manual operation. In the preferred embodiment, Referring to FIG. 6, the sink roll scraper system includes a digital controller 100 for controlling the lateral movement of the transport shaft 38, and the linear movement of the arms 18, 20. Movement of scraper pneumatic cylinders 34, 36 and electromechanical actuator motor 40 are controlled by an electrical signal from a digital computer device, preferably a programmable logic controller (PLC) 100. The operator may select from automatic or manual modes of control. Each arm is capable of independent operation, permitting the operator to selectively scrape an area on the roll surface. Under normal operation, arms 18,20 are applied alternately to the scraper roll, under pressure from their associated cylinders. The cylinder pressure is adjustable through the PLC. Pressure is varied by the PLC over a full range from zero to maximum operating pressure. The line operating pressure in the preferred embodiment is approximately 50 pounds per square inch The preferred pressurizing gas is nitrogen, although any compressed gas may be used.

The scraper operates cyclically in automatic mode, scraping the roll surface for a portion of every hour. For example, in a Zn—Al coating line, the cycle setting in the preferred embodiment is approximately ten minutes per hour of operation. The portion of time may be varied by the operator according to factors such as coating hardness or line speed.

While the blades are scraping the roll, transport shaft 42 oscillates horizontally above the pot 12, moving the support member 14 and the blades transversely, so that the entire width of the roll 16 is covered by the dual blade configuration. Generally, the lateral stroke of the transport shaft 42 and traversing cylinder 38 does not exceed one-half the width of the roll, and may be less than one half the roll width, depending on the width of the blades. The short stroke reduces cycle time for scraper blade assemblies 22,24 to pass back and forth across the roll surface.

The electromechanical actuator motor 40 for the transport shaft 42 is preferably a variable speed motor, controlled through the PLC. Control may be automatic or manual, as indicated above.

Control signals are derived from a combination of Operator requests and System Interfaces, processed through the programmable controller. The pneumatic cylinders are controlled by a combination of an electronic pressure regulator in line with a spring return single solenoid operated directional valve, preferably, although a dual directional valve configuration is also capable of operating the cylinders.

An electronic pressure regulator valve (not shown) is controlled by an analog signal over its operating range of control pressure. The analog signal is generated from the PLC using the Operator Requested pressure setting from the human machine interface (HMI), which is described in greater detail below. Any changes in pressure set point are ramped in the PLC for smooth operation. Directional valves 102, 104 transfer the controlled pressure from the regulators 106,108 to stroke the cylinders up or down. The downstroke engages and upstroke disengages the scraper heads from the sink roll. The signal to energize the directional valves solenoids is derived from an operator request input to the PLC 100 to engage the scraper head assemblies 22,24, when in manual control, or from an HMI when the PLC is set in automatic mode. In the preferred embodiment, the directional valves are proportionally controlled via the PLC. It is noted that control of the directional valves via the PLC is disclosed by way of example and not by limitation. Other, less sophisticated means may be employed within the scope and spirit of the present invention, to control the operation of the cylinders. For example, direct manually operated directional valves, or relay-operated valves may be employed The PLC 100 transmits a speed control signal to variable frequency drive 110 for the frequency set point. PLC 100 also transmits separate control signals for Run, Forward and Reverse operation. The drive 110 transmits signals to PLC 100 to indicate drive running, speed and motor current controller, for control processing. PLC logic determines when the limit of travel is reached by reference to drive running, speed and current signals. When the limit of travel is detected in one direction, further movement in that direction is inhibited by the PLC.

Human Machine Interface (HMI) Description

Figure 7:
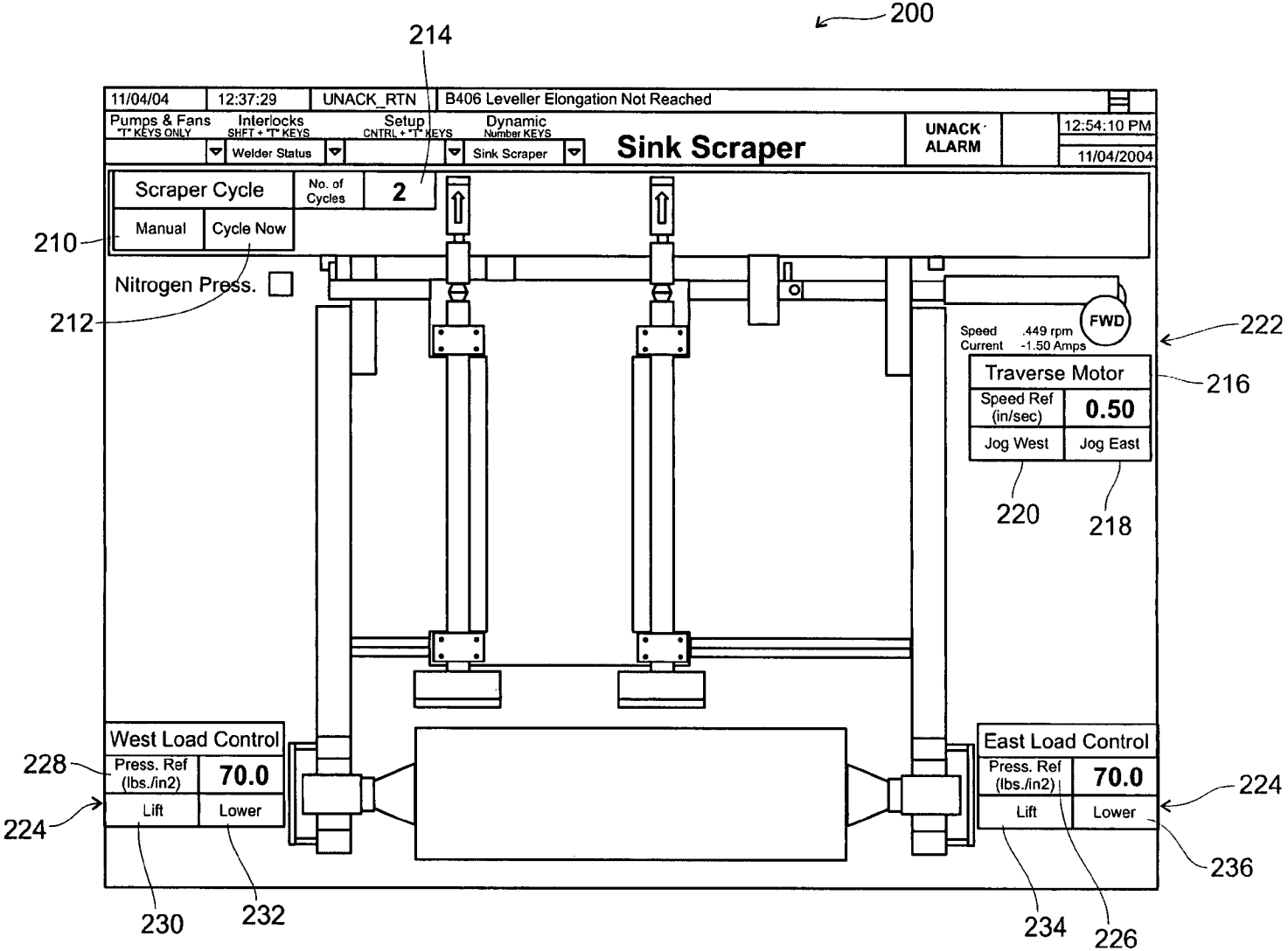
FIG. 7 is a human machine interface displaying the invention in manual control mode.
Figure 8:
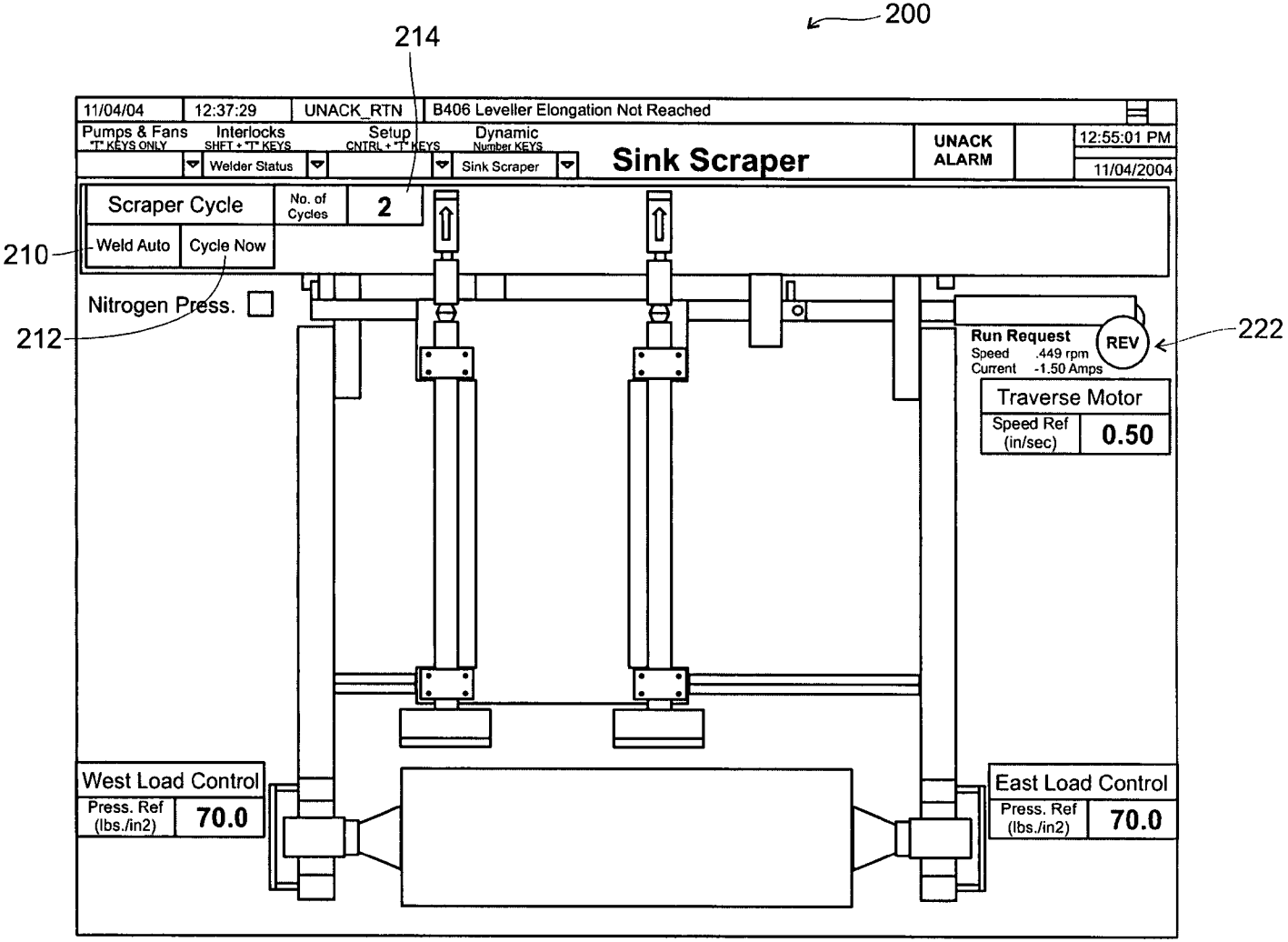
FIG. 8 is a FIG. 7 is a human machine interface displaying the invention in automatic control.

There is an interactive human machine interface (HMI) 200 provided with the scraper unit, in electrical communication with the PLC or other digital controller. The HMI 200 comprises a graphical screen as shown in FIGS. 7 & 8. Any of a number of commercially available touchscreen devices may be used for the interface screen. FIG. 7 shows the scraper unit in manual control mode. FIG. 8 shows the scraper in automatic control mode. The mode of operation may be switched from manual to auto by the manual/auto button 210. The automatic sequence can be triggered from the "cycle now" button 212 when in automatic mode. By "button", what is meant is a graphical depiction of a button on the screen, representing a virtual pushbutton. The screen area of the button is touched by the operator to select the option that is represented by the button. The number of complete cycles that the automatic sequence should complete can be adjusted by the "No. of cycles" input button 214.

The traverse movement of the scraper (referred to as "East" and "West") is controlled from the traverse motor interface 216. The traverse motor interface button 216 allows the operator to change the speed of traverse via the speed reference operator input, and to jog the scraper unit East and West via the jog pushbuttons 218, 220. Jog East and jog West buttons are visible only in manual mode. Indications of motor running, direction, speed and current are displayed to the operator 222. Up and down movement of the scraper blade assemblies is controlled from the scraper head interface 224.

The East and West scraper heads interfaces allow the operator to change the scraping pressure via the pressure reference operator inputs 226, 228 and to lift and lower the heads to engage and disengage them from the sink roll via the lift/lower buttons 230-236. Lift and lower buttons 230-236 are visible only in manual mode. In automatic mode, the arms and scraper blade assemblies are interlocked to operate in unison, and raising and lowering is done through the PLC according to the selected time cycle. Optionally, other indicators on the screen indicate nitrogen pressure; traverse fully east and fully west; and cylinder directional valve commands.

The scraper heads scraping pressure references may be adjusted by the operator input from 0 to line pressure, which in the disclosed embodiment is approximately 70 psi. These signals are interpreted by the PLC and converted to an analog signal for the electronic pressure regulators.

Automatic System Control

In automatic mode the scraper directional movements are controlled entirely by the PLC using operator input speed and pressure reference values.

The automatic sequence is enabled when the scraper is selected for auto mode and the process line is running. The automatic method for scraping the roll while the roll is rotating in the pot of molten metal is as follows:

The support assembly is traversed by the transport shaft to one side and the arms attached to the support assembly are lifted to a fully retracted position, disengaging the scraper blades from contact with the roll surface. A scraper cycle is then initiated by means of a trigger signal. Next, the arm that is positioned above the mid-point of the roll is lowered against the sink roll, the pressure reference is increased from lifting pressure to approximately zero, and directional valves are energized. The pressure value is gradually increased to a preselected pressure suitable for cleaning dross from the roll surface. The cylinder is then extended in a controlled manner to engage the scraper head gently on to the sink roll. The scraper head is then moved laterally by the transport shaft acting on the support member at a controlled, predetermined speed from the sink roll mid point to the fully traversed out position. The opposing arm is now positioned at the mid-point of the sink roll and the arm is lowered to engage the roll surface, while the first arm is retracted from the roll surface. The traversing means stops upon reaching the fully traversed out position. Then the scraper head is lifted from the roll surface by removing pressure from the cylinder, returning the arms to the retracted position. The transport shaft is returned to the starting position and the sequence is then repeated until a predetermined number of cycles are completed. A counter in the control means is incremented after each cycle. The counter value is compared with the number of selected cycles after each repetition of a cycle. The cycle is repeated until the counter value matches the number of cycles selected. The support assembly then traverses to one side of the sink roll and lifts the arms away from the surface of the roll. The trigger may be 1) a timer within the PLC which activates the sequence on a regular time based interval; 2) a weld signal from the weld tracking logic in the PLC; or 3) an operator initiated "Cycle Now" pushbutton.

The automatic sequence is enabled when the scraper is selected for auto mode and the process line is stopped. The sequence executes the following steps:

Return the traverse to the fully west side (unless already at fully east side) and both scraper heads are commanded to lift. Wait for a sequence trigger. The trigger originates from a timer in the PLC which activates the sequence on a regular time based interval, or from an operator initiated "Cycle Now" button. The traverse drive is commanded to run at the operator input speed reference to move from one end of travel to the opposite end of travel. When the PLC detects that the traverse motor has reached end of travel the command to run is released. Both scraper heads are commanded to lower. The PLC commands the pressure references to ramp from lifting pressure to approximately zero psi. When the pressure references have reached approximately zero pressure the directional valves are energized and the pressures are ramped to the scraping pressure reference. This causes the cylinders to extend in a controlled manner to engage the scraper heads gently on to the sink roll.

Scraper heads are then commanded to disengage or lift away from the roll surface. The PLC transmits a signal to the directional valves to de-energize, causing the cylinders to retract and the heads to lift. The PLC checks whether the pre-selected number of cycles have been completed, if not the cycle is repeated, and if so, the scraper assembly returns to the resting position.

Figure 9A:
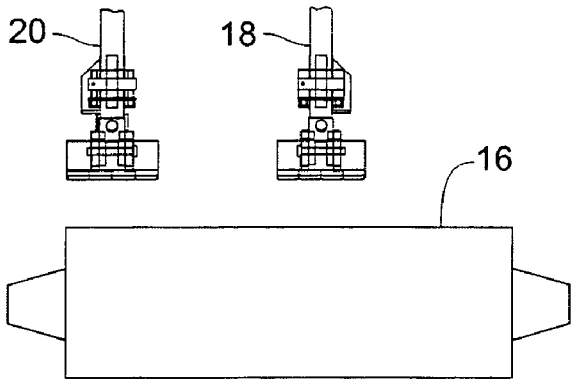
FIGS. 9A through 9D illustrate a sequence of operation for one cycle of the preferred method and apparatus of the invention.
Figure 9B:
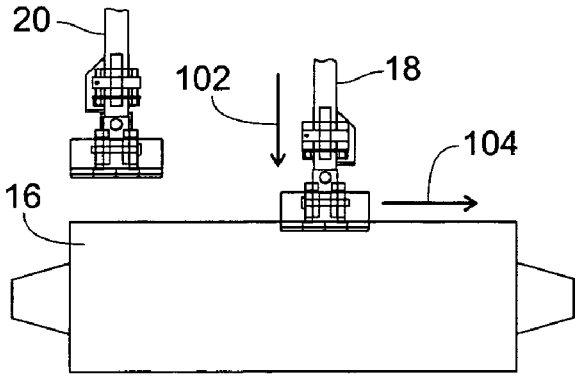
Figure 9C:
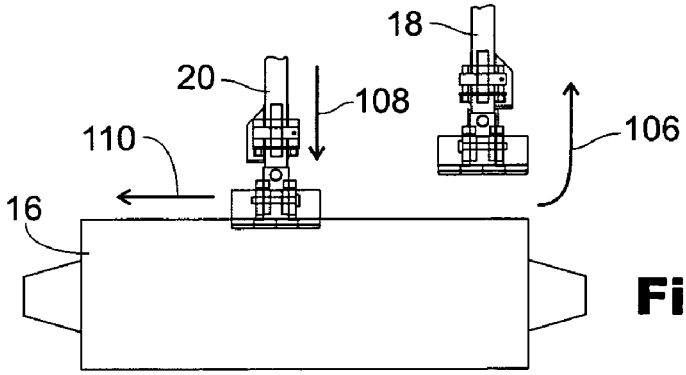
Figure 9D:
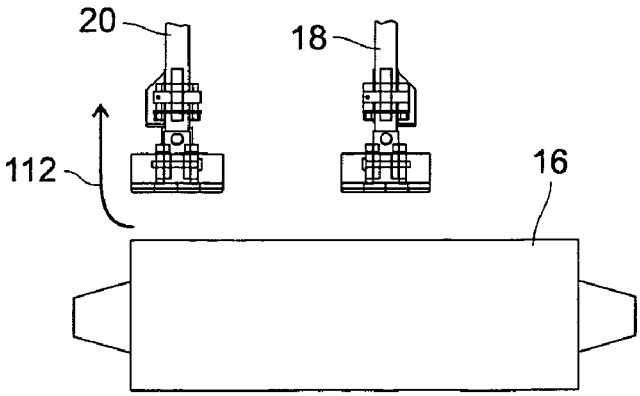

Referring next to FIGS. 9A through 9D, a cycle is illustrated, by way of example and not by limitation. In FIG. 9A, the normal resting position is illustrated, in which arms 18, 20 are both in the raised position above roll 16. Arm 18 is disposed above the approximate mid-point of the roll. In FIG. 9B, the first step of the sequence is to lower the arm directly above the mid-point against the roll, as indicated by arrow 102, and traverse to the edge of the roll opposite arm 20, as indicated by arrow 104. In FIG. 9C, the next step of the cycle is to raise the arm 18 which is now at or beyond the edge of roll 16, as indicated by arrow 106. Arm 20 is now disposed above the approximate mid-point, and is lowered against the roll as indicated by arrow 108, and traverses the roll in the opposite direction as indicated by arrow 110. In FIG. 9D, the last step of the cycle is shown, in which arm 20 is raised after reaching the edge of roll 16, and both arms 18, 20 are in the raised position in which they began the cycle. This cycle may be repeated manually, or by use of the automated feature by selecting the number of cycles in the automatic mode as described above. It should be noted that the cycle described in FIGS. 9A-9D is only one of many possible sequential combinations that may be employed in the present invention. Other sequences may be used, and the invention may be practiced non-cyclically as well, such as when the operator sets the position of one or both scrapers using manual control mode, to scrape the roll at a specified point where, for example, a dent occurs in the strip.

According to the provisions of the patent statutes, we have explained the principle, preferred construction, and mode of operation of the present invention, and have illustrated and described what we now consider to represent its best embodiments. However, it should be understood that within the scope of the appended claims and the foregoing description, the present invention may be practiced otherwise than as specifically illustrated and described.

We claim:

1. An apparatus for scraping a roll surface in a molten metal coating process comprising:

a) a support member having a pair of linearly movable arms supported thereon, said support member depending from a bridge structure spanning a continuous metal coating line;

b) said arms being disposed on opposite sides of said support member;

c) each of said arms having a scraper assembly portion attached thereto; and d) each scraper assembly portion having at least one blade attached thereto;

e) means for advancing said arms such that at least one said scraper blade presses against the roll surface under pressure; and f) traversing means for communicating lateral movement of said blades laterally along the axis of the roll while scraping against the roll.

2. The apparatus for scraping a roll surface as set forth in claim 1, wherein said means for advancing arms comprises a cylinder operatively connected to and responsive to a source of pressurized gas.

3. The apparatus for scraping a roll surface as set forth in claim 1, wherein each scraper assembly portion having a forward scraper blade and a rear scraper blade, and a connecting portion having a first pivot point for attaching said connecting portion to the arm associated with said scraper, said first pivot point being disposed between said forward and rear scraper blade for following the radial contours of the roll surface.

4. The apparatus for scraping a roll surface as set forth in claim 3, wherein said blade assembly also having a pair of limit portions to restrict the angle of rotation about the pivot point of said blade assembly in relation to said arm.

5. The apparatus for scraping a roll surface as set forth in claim 3, wherein said means for pivotally connecting each said scraper assembly to the associated arm includes a second pivot point for said scraper assembly relative to said arm, to allow said blades to pivot along the crowned axis of the roll.

6. The apparatus for scraping a roll surface as set forth in claim 1, wherein also comprising a control means for controlling the pressure of the scraping force of said blades applied to the roll surface.

7. The apparatus for scraping a roll surface as set forth in claim 6, wherein said means for advancing arms comprises a cylinder operatively connected to and responsive to a source of pressurized gas, the pressure in said cylinder being is variably controlled by said control means.

8. The apparatus for scraping a roll surface as set forth in claim 6, wherein said control means comprises a digital controller in electronic communication with an analog device, such that the pressure may be varied over a predefined range corresponding to zero pressure up to full line pressure.

9. The apparatus for scraping a roll surface as set forth in claim 8, wherein said analog device is a proportional control valve.

10. The apparatus for scraping a roll surface as set forth in claim 8, wherein said control means controls a plurality of controlled variables, said plurality of controlled variables modes being selected from the group comprising, manual, automatic, blade positions, traversing speed, cylinder pressure and scraper cycles.

11. The apparatus for scraping a roll surface as set forth in claim 10, wherein said arms are capable of independent operation through one or more control modes, such that one arm, or the other arm or both arms may be advanced against the roll surface for selectively positioning the blade or blades.

12. The apparatus for scraping a roll surface as set forth in claim 1, wherein said traversing means comprises a motor, an actuator portion, and a cylinder portion, said cylinder portion being operatively connected to said support member, such that said motor drives said actuator portion, thereby imparting linear motion to said support member through said cylinder portion, causing said blade or blades to traverse the horizontal axis in contact with the surface of the roll.

13. The apparatus for scraping a roll surface as set forth in claim 12, wherein also comprising a speed control interface in electronic communication with said motor portion and said control means controlling the speed of said motor from a speed reference point communicated from said control means.

14. The apparatus for scraping a roll surface as set forth in claim 13, wherein also including an interactive human machine interface in electronic communication with said control means, for displaying an image of the apparatus and having visual descriptors thereon for selecting operator controlled parameters.

15. The apparatus for scraping a roll surface as set forth in claim 1, wherein the apparatus is movably attached to a lateral guide member, the lateral guide member connected to the roll, wherein the lateral guide member directs an angle of incidence of the arms with the roll, and supports at least a portion of the weight of said apparatus.

16. An apparatus for scraping a roll surface in a molten metal coating process comprising:

a support member having a pair of linearly movable arms supported thereon, said support member depending from a bridge structure spanning a continuous metal coating line;

said arms being disposed on opposite sides of said support member;

each of said arms having a scraper assembly portion attached thereto;

each scraper assembly portion having a forward scraper blade and a rear scraper blade, and a connecting portion having a first pivot point for attaching said connecting portion to the arm associated with said scraper, said first pivot point being disposed between said forward and rear scraper blade for following the radial contours of the roll surface;

means for advancing said arms such that at least one said scraper blade presses against the roll surface under pressure, control means for controlling the pressure of the scraping force of said blades applied to the roll surface; and traversing means for communicating lateral movement of said blades laterally along the axis of the roll while scraping against the roll.

17. The apparatus for scraping a roll surface as set forth in claim 16, wherein said means for advancing arms comprises a cylinder operatively connected to and responsive to a source of pressurized gas.

18. The apparatus for scraping a roll surface as set forth in claim 16, wherein said blade assembly also having a pair of limit portions to restrict the angle of rotation about the pivot point of said blade assembly in relation to said arm.

19. The apparatus for scraping a roll surface as set forth in claim 16, wherein said means for pivotally connecting each said scraper assembly to the associated arm includes a second pivot point for said scraper assembly relative to said arm, to allow said blades to pivot along the crowned axis of the roll.

20. The apparatus for scraping a roll surface as set forth in claim 16, wherein also comprising a control means for controlling the pressure of the scraping force of said blades applied to the roll surface.

21. The apparatus for scraping a roll surface as set forth in claim 20, wherein said means for advancing arms comprises a cylinder operatively connected to and responsive to a source of pressurized gas, the pressure in said cylinder being is variably controlled by said control means.

22. The apparatus for scraping a roll surface as set forth in claim 20, wherein said control means comprises a digital controller in electronic communication with an analog device, such that the pressure may be varied over a predefined range corresponding to zero pressure up to full line pressure.

23. The apparatus for scraping a roll surface as set forth in claim 22, wherein said analog device is a proportional control valve.

24. The apparatus for scraping a roll surface as set forth in claim 22, wherein said control means includes a plurality of control modes, said plurality of control modes being selected from the group comprising, manual, automatic, blade positions, and traversing speed.

25. The apparatus for scraping a roll surface as set forth in claim 24, wherein said arms are capable of independent operation through one or more control modes, such that one arm, or the other arm or both arms may be advanced against the roll surface for selectively positioning the blade or blades.

26. The apparatus for scraping a roll surface as set forth in claim 16, wherein said traversing means comprises a motor, an actuator portion, and a cylinder portion, said cylinder portion being operatively connected to said support member, such that said motor drives said actuator portion, thereby imparting linear motion to said support member through said cylinder portion, causing said blade or blades to traverse the horizontal axis in contact with the surface of the roll.

27. The apparatus for scraping a roll surface as set forth in claim 26, wherein also comprising a speed control interface in electronic communication with said motor portion and said control means controlling the speed of said motor from a speed reference point communicated from said control means.

28. The apparatus for scraping a roll surface as set forth in claim 26, wherein also including an interactive human machine interface in electronic communication with said control means, for displaying an image of the apparatus and having visual descriptors thereon for selecting operator controlled parameters.

29. The apparatus for scraping a roll surface as set forth in claim 16, wherein the apparatus is movably attached to a lateral guide member, the lateral guide member connected to the roll, wherein the lateral guide member directs an angle of incidence of the arms with the roll, and supports at least a portion of the weight of said apparatus.

* * * * *

UNITED STATES PATENT AND TRADEMARK OFFICE

CERTIFICATE OF CORRECTION

PATENT NO. : 7,341,629 B2
APPLICATION NO. : 11/058127
DATED : March 11, 2008
INVENTOR(S) : Erin G. Sapp et al.

It is certified that error appears in the above-identified patent and that said Letters Patent is hereby corrected as shown below:

Column 5, Line 36, "preferrably employs"...should be --preferably employs--
Column 6, Line 30, "results It"...should be --results. It--
Column 7, Line 33, "energize the directional valves"...should be --energize the directional valve--

Signed and Sealed this

Twenty-seventh Day of October, 2009

David J. Kappos

David J. Kappos
*Director of the United States Patent and Trademark Office*